US006698398B2

(12) United States Patent
Bauerle

(10) Patent No.: US 6,698,398 B2
(45) Date of Patent: Mar. 2, 2004

(54) COMPENSATION OF THROTTLE AREA USING INTAKE DIAGNOSTIC RESIDUALS

(75) Inventor: Paul Alan Bauerle, Fenton, MI (US)

(73) Assignee: General Motors Corporation, Detroit, MI (US)

( * ) Notice: Subject to any disclaimer, the term of this patent is extended or adjusted under 35 U.S.C. 154(b) by 116 days.

(21) Appl. No.: 10/128,220

(22) Filed: Apr. 23, 2002

(65) Prior Publication Data

US 2003/0196639 A1 Oct. 23, 2003

(51) Int. Cl.[7] ..... F02D 9/02; F02D 41/04
(52) U.S. Cl. ..... 123/399; 123/361
(58) Field of Search ..... 123/350, 352, 123/361, 399

(56) References Cited

U.S. PATENT DOCUMENTS

| | | | | | |
|---|---|---|---|---|---|
| 4,763,264 | A | * | 8/1988 | Okuno et al. | 123/399 |
| 4,799,467 | A | * | 1/1989 | Ishikawa et al. | 123/399 |
| 5,094,213 | A | * | 3/1992 | Dudek et al. | 123/478 |
| 6,497,227 | B2 | * | 12/2002 | Wang et al. | 123/568.16 |
| 2003/0065483 | A1 | * | 4/2003 | Ting et al. | 702/185 |

* cited by examiner

*Primary Examiner*—Tony M. Argenbright
(74) *Attorney, Agent, or Firm*—Christopher DeVries

(57) ABSTRACT

A method and apparatus compensates throttle area in an engine control system with an electronic throttle using intake diagnostic residuals. A plurality of tables relate throttle area, breakpoint numbers, flow loss factors and residual values. At least one of the tables is updated based on the intake diagnostic residuals to generate a compensated throttle area.

44 Claims, 5 Drawing Sheets

FIG. 4

| Throttle Area % | Breakpoint Number | Actual Residual Ratio |
|---|---|---|
| 0 | 0 | 0 |
| 5 | 1 | -0.2 |
| 10 | 2 | -0.15 |
| 15 | 3 | -0.3 |
| 20 | 4 | -0.1 |
| 30 | 5 | 0.1 |
| 50 | 6 | 0 |
| 75 | 7 | 0 |
| 100 | 8 | 0 |

FIG. 5

| Flow Loss Factor | Residual |
|---|---|
| 0.8 | -1 |
| 0.9 | -0.15 |
| 0.9 | -0.1 |
| 0.95 | -0.05 |
| 1 | 0 |
| 1.05 | 0.05 |
| 1.1 | 0.1 |
| 1.15 | 0.15 |
| 1.2 | 1 |

FIG. 6

| Filtered Flow Loss Factor | Breakpoint Number |
|---|---|
| 0.96 | 0 |
| 0.894801 | 1 |
| 0.9 | 2 |
| 0.885618 | 3 |
| 0.922128 | 4 |
| 1.069452 | 5 |
| 1 | 6 |
| 1 | 7 |
| 1 | 8 |

FIG. 7

| Throttle Area % | Breakpoint Number |
|---|---|
| 0 | 0 |
| 4.474 | 1 |
| 9 | 2 |
| 13.28427 | 3 |
| 18.444256 | 4 |
| 32.08355 | 5 |
| 49.999 | 6 |
| 74.999 | 7 |
| 99.999 | 8 |

COMPENSATION OF THROTTLE AREA USING INTAKE DIAGNOSTIC RESIDUALS

TECHNICAL FIELD

The present invention relates to control systems for internal combustion engines, and more particularly to control systems for compensating throttle area of a throttle body.

BACKGROUND OF THE INVENTION

Electronic throttle control (ETC) systems replace the mechanical pedal assemblies that are currently used in vehicles. ETC systems enhance overall engine management while reducing the cost of the vehicle. Traditional engine controls rely on direct input from drivers and numerous valves and linkages to manage the engine. These systems do not allow consistent throttle control.

ETC sensors eliminate the linkage that is used to connect the accelerator pedal to the throttle body. ETC sensors take input from the driver's foot and send it to an engine control system in real time. The engine control system modulates the air/fuel flow to the engine. Direct control of the engine is shifted from the driver to the engine control system to improve efficiency.

ETC also can be coordinated with the shifting of the transmission, whereas mechanical systems react solely to the torque applied by the engine. Mechanical systems shift under high-load conditions, which may decrease the life of the transmission over time. ETC systems can reduce throttle, shift, and then increase throttle. This approach will increase the life of the transmission.

As throttle body coke deposits build up on a throttle blade/bore during the life of a vehicle, a relationship between pedal position and throttle response may deteriorate. This deterioration can lead to reduced idle quality. Customers experiencing poor idle quality during a warranty coverage period will request service. As a result, the warranty cost of the vehicle increases. Customers experiencing poor idle quality after the warranty coverage period ends will have higher operating costs. Other conditions that may adversely impact throttle response include variations in an airflow breakout region position, dirty air cleaners, and/or non-linearity in throttle position sensors.

SUMMARY OF THE INVENTION

A method and apparatus according to the present invention compensates throttle area in an engine control system with an electronic throttle using intake diagnostic residuals. A plurality of tables relate throttle area, breakpoint numbers, flow loss factors and residual values. At least one of the tables is updated based on the intake diagnostic residuals to generate a compensated throttle area.

In other features of the invention, a first table relates throttle area to breakpoint numbers and residual values. A second table relates residual values to flow loss factors. A third table relates flow loss factors to breakpoint numbers. A fourth table relates throttle area to breakpoint numbers.

In another feature of the invention, a desired throttle area is obtained from a pedal position sensor and/or a cruise control. A current throttle area is used to lookup a first breakpoint number in the first table. The first breakpoint is rounded. An absolute value of a difference between the rounded first breakpoint number and the first breakpoint number is compared to a hysteresis calibration value. The third or fourth tables are updated only when the absolute value is less than the hysteresis calibration value.

In other features of the invention, a current residual value is obtained from an intake diagnostic. Based on the current residual value, a flow loss factor is obtained from the second table. Using the rounded first breakpoint number, a flow loss factor is obtained from the third table. A filtered flow loss factor is calculated from the flow loss factors of the second and third tables. The filtered flow loss factor is stored in the third table in a position corresponding to the rounded first breakpoint number.

In still other features, a clean throttle area is obtained from the first table using the rounded first breakpoint number. The filtered flow loss factor is multiplied by the clean throttle area to provide a product. The fourth table is updated with the product in a position corresponding to the rounded first breakpoint number.

In still other features, a compensated breakpoint number is obtained from the fourth table based on the desired throttle area. A compensated throttle area is obtained from the first table using the compensated breakpoint number.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 4 is a first lookup table relating throttle area to breakpoint numbers and residual values;

FIG. 5 is a second lookup table relating flow loss factors to residual values;

FIG. 6 is a third lookup table relating flow loss factors to breakpoint numbers;

FIG. 7 is a fourth lookup table relating throttle area to breakpoint numbers.

DESCRIPTION OF THE PREFERRED EMBODIMENT

The following description of the preferred embodiment(s) is merely exemplary in nature and is in no way intended to limit the invention, its application, or uses.

Part of the responsibility of an engine control diagnostic system includes the compensation of airflow due to VE, exhaust gas recirculation (EGR), intake air temperature (IAT), variable valve timing, variable displacement, and other engine system inputs. Suitable engine control diagnostic systems with compensation include "Fault Identification Diagnostic for Intake System Sensors", Ser. No. 09/961,537, filed Sep. 20, 2001, which is assigned to the assignee of the present invention and is hereby incorporated by reference. The engine control diagnostic system disclosed therein includes an intake diagnostic that generates residual values that represent differences between actual and estimated airflow and actual and estimated manifold absolute pressure (MAP).

The present invention uses the residuals that are generated by the intake diagnostic systems to compensate the throttle body for actual airflow progression throughout an operating range of a throttle blade opening. As used herein, residuals refer to a ratio between (sensed-estimated)/estimated. Generally, the present invention employs the throttle body airflow relationship (or progression) for an ideal throttle body and creates a learned table representing the actual airflow progression using the residual values from the intake diagnostic system. The present invention employs inverted functions such as table lookups with interpolation as will be described more fully below.

Figure 1:
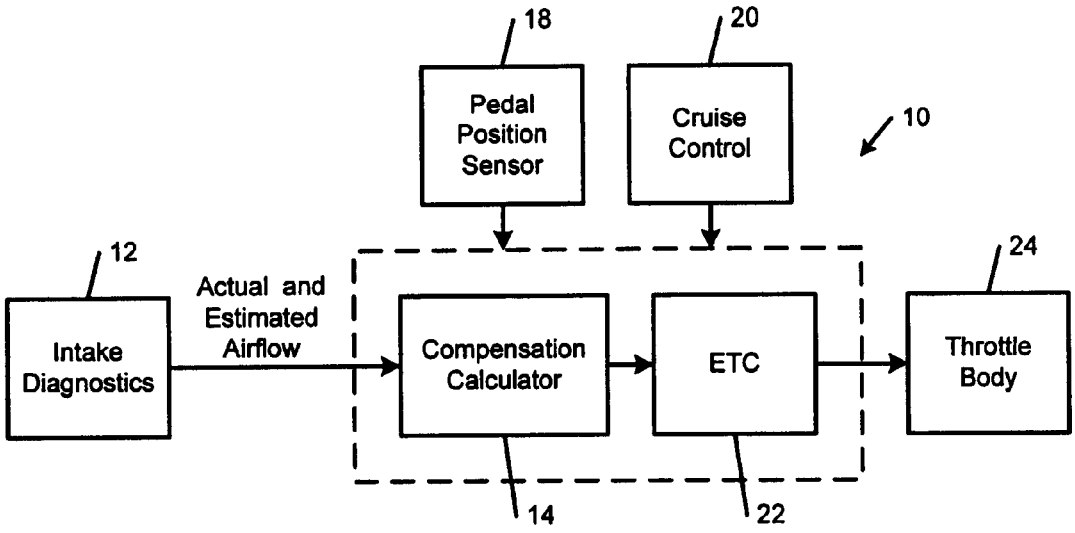
FIG. 1 is a functional block diagram of a throttle area compensation system according to the present invention that employs estimated and actual airflow.

Referring now to FIG. 1, a throttle body compensation system is shown and includes a residual generator 12 that generates actual and estimated mass airflow (MAF) signals. A compensation calculator 14 is connected to the intake diagnostic 12, a pedal position sensor 18, and a cruise control 20. A compensated throttle area is output by the compensation calculator 14 to an electronic throttle control 22. Alternately, the compensation calculator 14 and the electronic throttle control 22 are combined into a single functional block. The electronic throttle control 22 controls a throttle area of a throttle body 24.

In use, the pedal position sensor 18 and/or cruise control 20 generate a desired throttle area (ta_desired). The compensation calculator 14, the electronic throttle control 22 and/or another device arbitrates between the signals that are generated by the pedal position sensor 18 and the cruise control 20. Due to throttle body coke deposits that build up on a throttle blade/bore during the life of a vehicle, a relationship between pedal position and throttle response may deteriorate. Other conditions that may adversely impact throttle response include variations in an airflow breakout region position, dirty air cleaners, and/or non-linearity in throttle position sensors. Therefore, the actual throttle area may need to be more or less than the desired throttle area to achieve the desired acceleration or pedal response. The compensation calculator 14 and/or the electronic throttle control 22 calculate a compensated throttle area based on the desired throttle area and the residuals as will be described further below.

Figure 2:
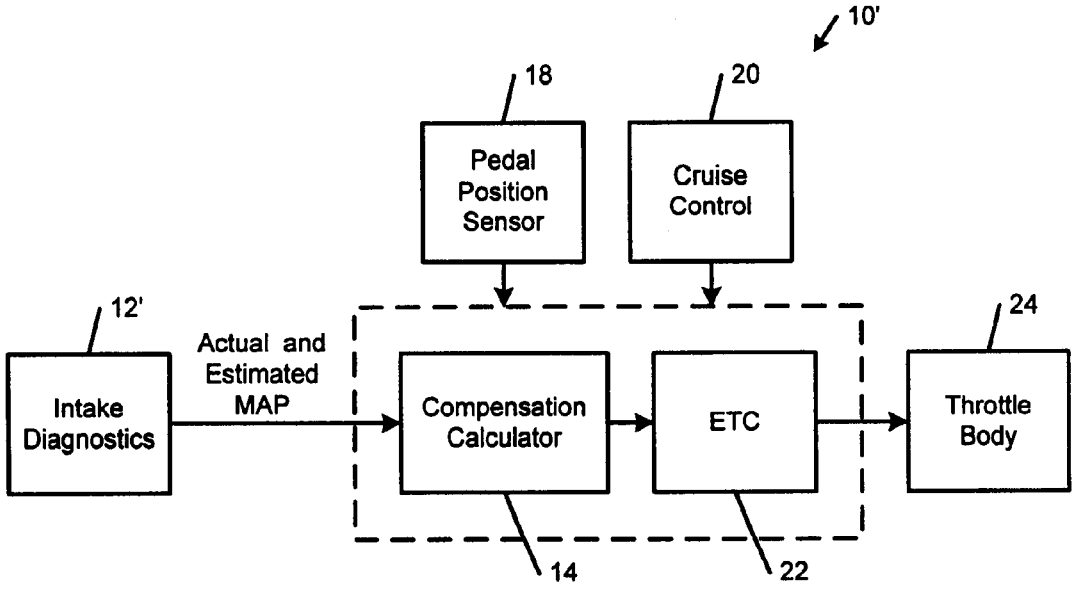
FIG. 2 is a functional block diagram of a throttle area compensation system according to the present invention that employs estimated and actual manifold absolute pressure (MAP)

Referring now to FIG. 2, a throttle body compensation system 10' can also use MAP residuals. For purposes of clarity, reference numbers from FIG. 1 are used in FIG. 2 where appropriate to identify similar elements. The intake diagnostic 12' generates actual and estimated MAP signals.

Figure 3:
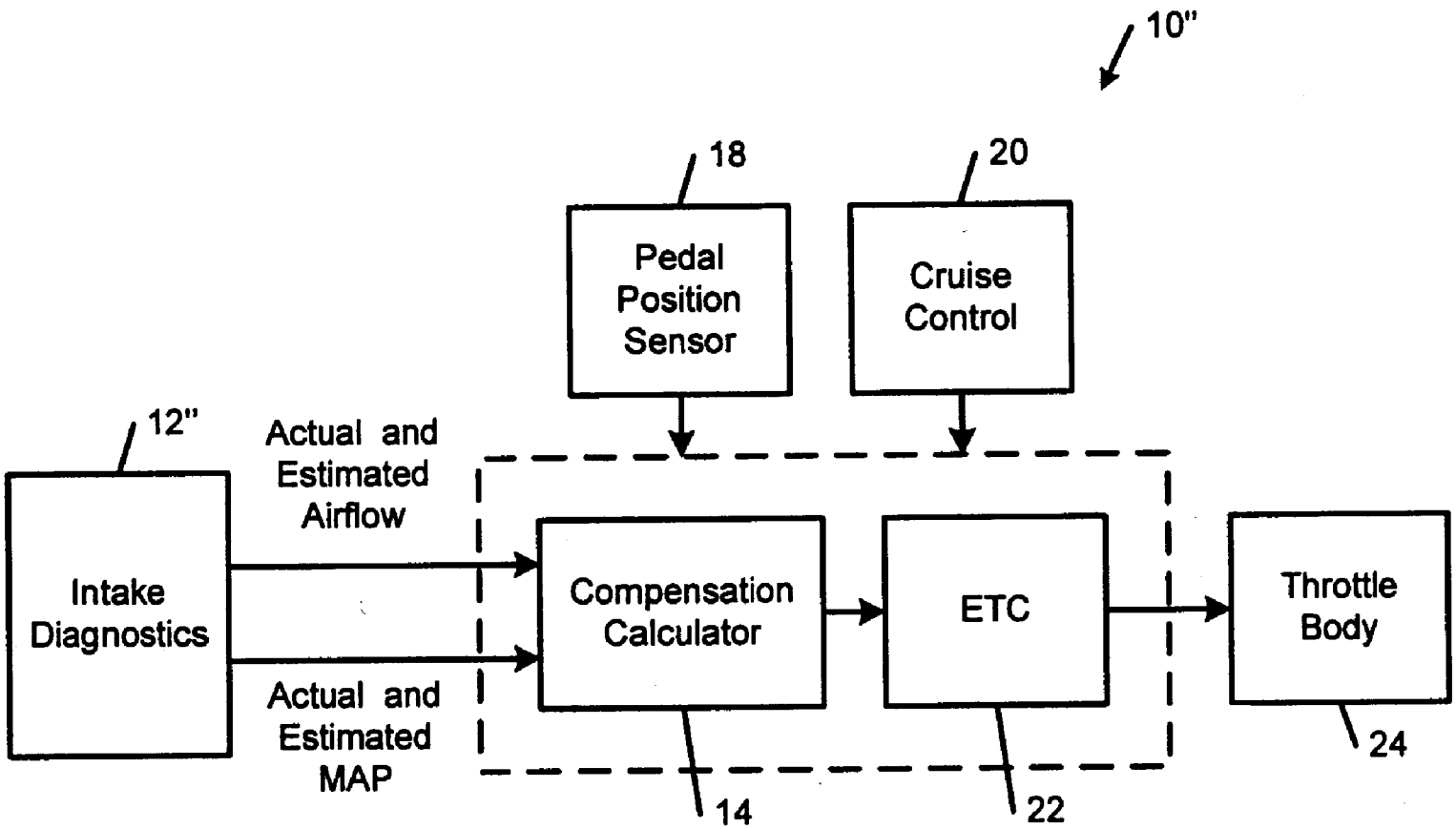
FIG. 3 is a functional block diagram of a throttle area compensation system according to the present invention that employs estimated and actual airflow and estimated and actual MAP.

Referring now to FIG. 3, a throttle body compensation system 10" can also use both airflow and MAP residuals. For purposes of clarity, reference numbers from FIG. 1 are used in FIG. 2 where appropriate to identify similar elements. The residual generator 12" generates both actual and estimated MAP and airflow signals. These residual values can be used individually, averaged or otherwise weighted. Alternately, other schemes may be employed.

Referring now to FIG. 4, a first lookup table relates throttle area to breakpoint numbers and residual values. Residuals start at or near zero for a new throttle body. The third column in FIG. 4 represents residuals that are typically encountered in an aged throttle body with coke deposits and/or nonlinearity. The third column is not part of the stored table. The first and second columns are preprogrammed.

Referring now to FIG. 5, a second lookup table relates flow loss factors to residual values. The table in FIG. 5 represents a relationship between residual and flow loss factors that are allowed for the amount of coking. The purpose of the values in FIG. 5 is to place limits on the authority of the throttle body compensation system.

Preferably, the tables in FIGS. 4 and 5 are programmed by the manufacturer and are not updated during operation.

Referring now to FIG. 6, a third lookup table relates flow loss factors to breakpoint numbers. The table in FIG. 6 is updated during operation of the vehicle based on the residual values. Referring now to FIG. 7, a fourth lookup table relates throttle area to breakpoint numbers. The table in FIG. 7 is also updated during operation of the vehicle based on residual values. As can be appreciated, the values listed in FIGS. 4–7 are exemplary values. Other values can be used.

Figure 8:
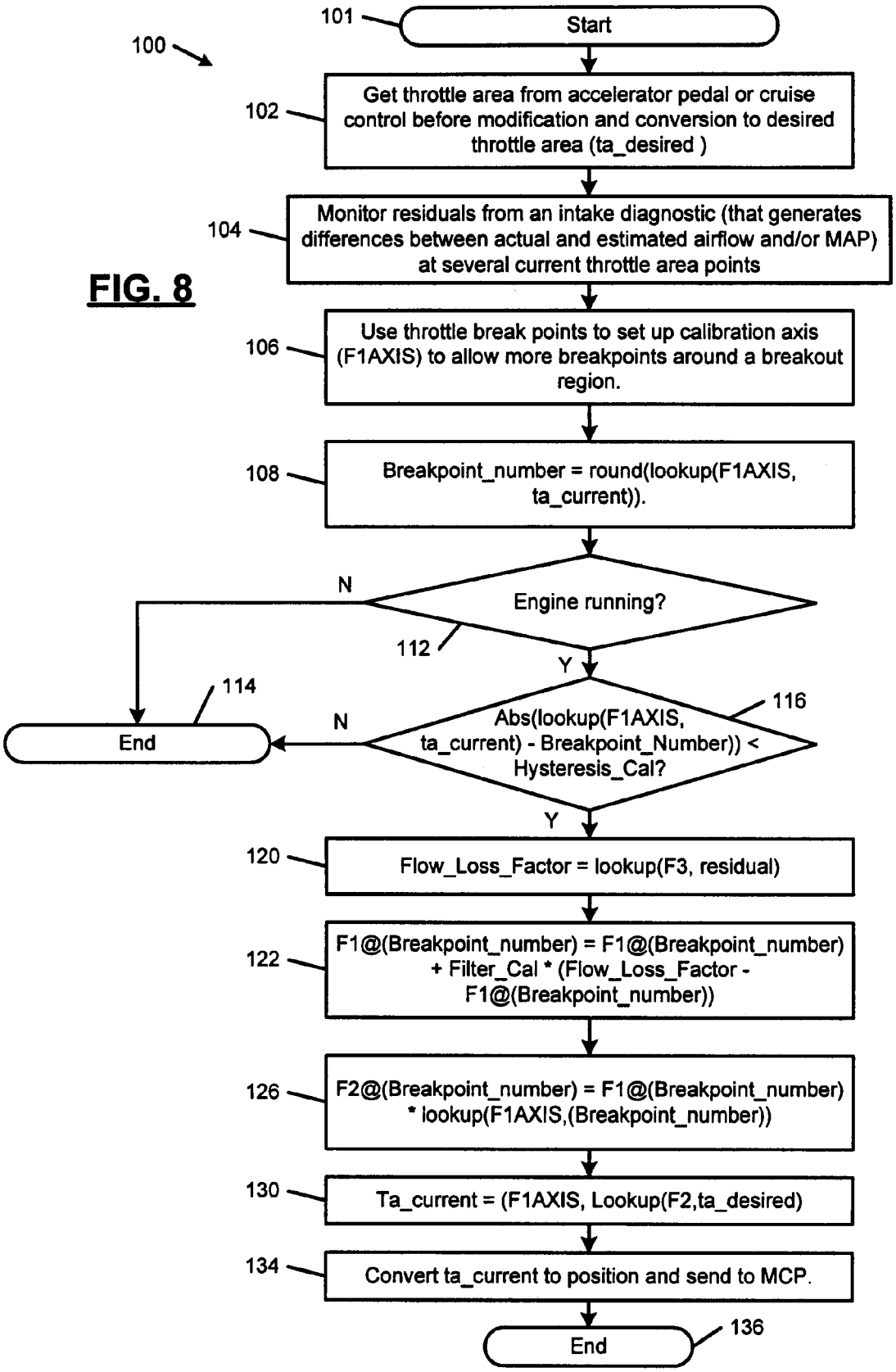
FIG. 8 is a flowchart illustrating steps performed by the throttle area compensation system.

Referring now to FIG. 8, steps for compensating the throttle body are shown generally at 100. In the following description, F1AXIS refers to the first table in FIG. 4. F3 refers to the second table in FIG. 5. F1 refers to the third table in FIG. 6. F2 refers to the fourth table in FIG. 7.

Control begins with step 101. In step 102, a throttle area is obtained from the accelerator pedal 18 or cruise control 20 before modification and conversion to desired throttle area (ta_desired). In step 104, residuals from an intake diagnostic (that generates differences between actual and estimated airflow and/or MAP) are monitored at several current throttle area points. In step 106, the throttle break points are used to set up calibration axis (F1AXIS—FIG. 4) to allow more breakpoints around a breakout region. In step 108, control determines whether Breakpoint_number=round (lookup(F1AXIS, ta_current)). In step 112, control determines whether the engine is running. If not control ends at step 114. Otherwise control continues with step 116 wherein a hysteresis calculation is performed as follows: Abs (Lookup(F1AXIS, ta_current)−Breakpoint_Number)) <Hysteresis_Cal. The Hysterisis_Cal is a hysteresis calibration value such as 0.3 that determines how close the breakpoint number must be to update the tables. A maximum value of 0.5 can be used.

In step 120, the Flow_Loss_Factor is set equal to Lookup(F3, residual). In step 122, F1@ (Breakpoint_number) is set equal to F1@ (Breakpoint_number)+Filter_Cal*(Flow_Loss$_{13}$ Factor−F1@ (Breakpoint_number))− which is a filter calculation. The Filter_Cal is a filter calibration value such as 0.1 that provides a weighting to the new air flow progression calculation. The filter calibration value can be a constant or a function of sign and/or magnitude of the residuals to handle rapid learning if a new/clean throttle body is detected. The filter coefficient can be reduced further by multiplying it by a $5^{th}$ table that is a function of the hysteresis calculation in step 116 to give higher weighting to values closer to the breakpoints.

In step 126, F2@ (Breakpoint_number) is set equal to F1@ (Breakpoint_number)*Lookup(F1AXIS, (Breakpoint_number)). In step 130, Ta_current is set equal to (F1AXIS, Lookup(F2,ta_desired). In step 134, ta_current is converted to position and sent to the throttle body. Control ends at step 136. The compensations are performed periodically, for example every 12.5 ms.

EXAMPLE

The following example will employ the exemplary values that are found in the tables of FIGS. 4–7. The pedal position sensor 18 and/or the cruise control 20 transmits a desired throttle area of 30. Therefore, ta_desired is set equal to 30. In this example, ta_current is equal to 28.47758 from the previous loop.

If the engine is running, a hysteresis calculation is performed. The value ta_current is used to determine a non-rounded breakpoint number, which is equal to 4.847758. The value is calculated as follows: 4+(5−4)* (30−18.44256)/(32.08355−18.44256)=4.847758. As can be appreciated, the non-rounded breakpoint number is interplated between table values. The rounded breakpoint number is equal to 5. The absolute value of the non-rounded breakpoint number (4.847758) is subtracted from the rounded breakpoint number (5). In this case, the absolute value is less than a Hysteresis_Cal (0.3). Therefore, the tables are updated. As can be appreciated, other values can be used for the hystersis calibration value to adjust the sensitivity of the update function.

A residual value is obtained from the intake diagnostic 12. In this case, the residual is equal to 0.069452. The Flow_Loss_Factor is obtained from the second table in FIG. 5 using the residual value from the intake diagnostic 12. In this case, the flow loss factor is 1.05+(1.1−1.05)*(0.069452−0.05)/(0.1−0.05)=1.069452.

A filtered flow loss factor is calculated. The current value of the flow loss factor is obtained from the third table F1 in FIG. 6 based on the rounded breakpoint number (5). In this case, the current flow loss factor is equal to 1.069452. The filtered flow loss factor is equal to (1.069452)+(0.1)(1.069452−1.069452)=1.069452, which is no change in the flow loss factor in this example. The filtered flow loss factor is saved in the third table a position corresponding to the rounded breakpoint number (5).

Then, clean throttle body area is multipled by the flow loss factor and stored for the breakpoint. First, the rounded breakpoint number (5) is used to lookup the clean throttle body area (30). The filtered flow loss factor for the rounded breakpoint number (5) is 1.069452. The fourth table in FIG. 7 is updated with the new value 30*1.069452=32.08356 for the rounded breakpoint 5.

Using an independent lookup, the compensated throttle area ta_current is determined based on the new fourth table. Using ta_desired=30, the breakpoint value is determined and is equal to 4+(5−4)*(30−18.44256)/(32.08356−18.44256)=4.8472575. Then this value is used to lookup ta_current in the first table, which is equal to 28.472575. This value of ta_current is the compensated throttle area. Since this example decreases throttle, the compensation in this region is for sensor nonlinearity or variation in the break-out region. An increase in the compensation throttle area typically represents compensation due to coking.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method for compensating throttle area in an engine control system with an electronic throttle using intake diagnostic residuals, comprising:

providing a plurality of tables that relate throttle area, breakpoint numbers, flow loss factors and residual values; and updating at least one of said tables based on said intake diagnostic residuals to generate a compensated throttle area.

2. The method of claim 1 further comprising:

providing a first table that relates throttle area to breakpoint numbers and residual values;

providing a second table that relates residual values to flow loss factors;

providing a third table that relates flow loss factors to breakpoint numbers; and providing a fourth table that relates throttle area to breakpoint numbers.

3. The method of claim 2 further comprising obtaining a desired throttle area from at least one of pedal position sensor and a cruise control.

4. The method of claim 3 further comprising:

looking up a first breakpoint number in said first table based on a current throttle area;

rounding said first breakpoint number.

5. The method of claim 1 wherein said residuals are based on at least one of mass airflow and manifold absolute pressure.

6. The method of claim 4 further comprising comparing an absolute value of a difference between said rounded first breakpoint number and said first breakpoint number to a hysteresis calibration value.

7. The method of claim 6 further comprising updating at least one of said third and fourth tables only when said absolute value is less than said hysteresis calibration value.

8. The method of claim 4 further comprising obtaining a current residual value from a said intake diagnostics.

9. The method of claim 8 further comprising looking up a flow loss factor in said second table based on said current residual value.

10. The method of claim 9 further comprising looking up a flow loss factor in said third table using said rounded first breakpoint number.

11. The method of claim 10 further comprising calculating a filtered flow loss factor.

12. The method of claim 11 further comprising saving said filtered flow loss factor to said third table in a position corresponding to said rounded first breakpoint number.

13. The method of claim 12 further comprising looking up a throttle area in said first table using said rounded first breakpoint number.

14. The method of claim 13 further comprising multiplying said filtered flow loss factor by said throttle area from said first table and updating throttle area of said fourth table in a position corresponding to said rounded first breakpoint number.

15. The method of claim 14 further comprising looking up a compensated breakpoint number in said fourth table based on said desired throttle area.

16. The method of claim 15 further comprising looking up a compensated throttle area in said first table using said compensated breakpoint number and using said compensated throttle area to control a throttle body.

17. A method for compensating throttle area in an engine control system with an electronic throttle using intake diagnostic residuals, comprising:

providing a first table that relates throttle area to breakpoint numbers and residual values;

providing a second table that relates residual values to flow loss factors;

providing a third table that relates flow loss factors to breakpoint numbers;

providing a fourth table that relates throttle area to breakpoint numbers; and updating at least one of said tables based on said intake diagnostic residuals to generate a compensated throttle area.

18. The method of claim 17 further comprising obtaining a desired throttle area from at least one of pedal position sensor and a cruise control.

19. The method of claim 18 further comprising:

looking up a first breakpoint number in said first table based on a current throttle area;

rounding said first breakpoint number; and comparing an absolute value of a difference between said rounded first breakpoint number and said first breakpoint number to a hysteresis calibration value.

20. The method of claim 19 further comprising updating at least one of said third and fourth tables only when said absolute value is less than said hysteresis calibration value.

21. The method of claim 20 further comprising:

obtaining a current residual value from said intake diagnostics; and looking up a flow loss factor in said second table based on said current residual value.

22. The method of claim 21 further comprising:

looking up a flow loss factor in said third table using said rounded first breakpoint number; and calculating a filtered flow loss factor.

23. The method of claim 22 further comprising saving said filtered flow loss factor to said third table in a position corresponding to said rounded first breakpoint number.

24. The method of claim 23 further comprising looking up a throttle area in said first table using said rounded first breakpoint number.

25. The method of claim 24 further comprising multiplying said filtered flow loss factor by said throttle area and updating said fourth table in a position corresponding to said rounded first breakpoint number.

26. The method of claim 25 further comprising looking up a compensated breakpoint number in said fourth table based on said desired throttle area.

27. The method of claim 26 further comprising looking up a compensated throttle area in said first table using said compensated breakpoint number and said compensated throttle area to control a throttle body.

28. A throttle area compensation system for an engine control system with an electronic throttle, comprising:

an intake diagnostic that generates residuals;

memory containing a plurality of tables that relate throttle area, breakpoint numbers, flow loss factors and residual values; and a throttle area compensation calculator that updates at least one of said tables based on said intake diagnostic residuals and generates a compensated throttle area based on said tables.

29. The throttle area compensation system of claim 28 wherein said memory includes a first table that relates throttle area to breakpoint numbers and residual values, a second table that relates residual values to flow loss factors, a third table that relates flow loss factors to breakpoint numbers; and a fourth table that relates throttle area to breakpoint numbers.

30. The throttle area compensation system of claim 29 further comprising at least one of pedal position sensor and a cruise control that provide a desired throttle area.

31. The throttle area compensation system of claim 30 wherein said throttle area compensation calculator looks up a first breakpoint number in said first table based on a current throttle area and rounds said first breakpoint number.

32. The throttle area compensation system of claim 28 wherein said residuals are based on at least one of mass airflow and manifold absolute pressure.

33. The throttle area compensation system of claim 31 wherein said throttle area compensation calculator compares an absolute value of a difference between said rounded first breakpoint number and said first breakpoint number to a hysteresis calibration value.

34. The throttle area compensation system of claim 33 wherein said throttle area compensation calculator updates at least one of said third and fourth tables only when said absolute value is less than said hysteresis calibration value.

35. The throttle area compensation system of claim 34 wherein said throttle area compensation calculator obtains a current residual value from said intake diagnostic.

36. The throttle area compensation system of claim 35 wherein said throttle area compensation calculator looks up a flow loss factor in said second table based on said current residual value.

37. The throttle area compensation system of claim 36 wherein said throttle area compensation calculator looks up a flow loss factor in said third table using said rounded first breakpoint number.

38. The throttle area compensation system of claim 37 wherein said throttle area compensation calculator calculates a filtered flow loss factor.

39. The throttle area compensation system of claim 38 wherein said throttle area compensation calculator saves said filtered flow loss factor to said third table in a position corresponding to said rounded first breakpoint number.

40. The throttle area compensation system of claim 39 wherein said throttle area compensation calculator looks up a throttle area in said first table using said rounded first breakpoint number.

41. The throttle area compensation system of claim 40 wherein said throttle area compensation calculator multiplies said filtered flow loss factor by said throttle area from said first table and updates throttle area of said fourth table in a position corresponding to said rounded first breakpoint number.

42. The throttle area compensation system of claim 41 wherein said throttle area compensation calculator looks up a compensated breakpoint number in said fourth table based on said desired throttle area.

43. The throttle area compensation system of claim 42 wherein said throttle area compensation calculator looks up a compensated throttle area in said first table using said compensated breakpoint number.

44. The throttle area compensation system of claim 42 wherein said compensated throttle area is used to control a throttle body.

* * * * *